United States Patent [19]

Cohn

[11] 4,218,806

[45] Aug. 26, 1980

[54] VACUUM DEVICE FOR HAIR

[76] Inventor: Bernard Cohn, 100 Princeton Ave., Bridgeton, N.J. 08302

[21] Appl. No.: 11,239

[22] Filed: Feb. 12, 1979

[51] Int. Cl.[2] ..... A47L 5/24

[52] U.S. Cl. ..... 15/402; 15/344

[58] Field of Search ..... 15/344, 397, 402

[56] References Cited

U.S. PATENT DOCUMENTS

| | | | |
|---|---|---|---|
| 2,276,886 | 3/1942 | Smith | 15/397 X |
| 2,276,944 | 3/1942 | Dow | 15/397 |
| 2,668,315 | 2/1954 | Crosby | 15/344 |
| 2,753,434 | 7/1956 | Storm | 15/344 X |
| 2,758,330 | 4/1956 | Sloan | 15/344 |
| 3,066,683 | 12/1962 | Pace | 15/344 X |
| 3,771,193 | 11/1973 | Hageal | 15/397 |
| 3,955,238 | 5/1976 | Remijas | 15/402 |

FOREIGN PATENT DOCUMENTS

| | | | |
|---|---|---|---|
| 1130856 | 10/1956 | France | 15/344 |

*Primary Examiner*—Christopher K. Moore
*Attorney, Agent, or Firm*—Darby & Darby

[57] ABSTRACT

A device for vacuuming particulate matter from an individual's scalp comprising a housing having a passage therethrough, a detachable implement member mounted to the housing, and a filter mounted transverse the passage for entrapping particulate matter. A motor and rotatable fan disposed within said housing creates a fluid flow capable of transporting the particulate matter. The implement member is detachably affixed by an arrangement of mating flanges to facilitate interchangeability of implement members of different sizes and shapes.

2 Claims, 5 Drawing Figures

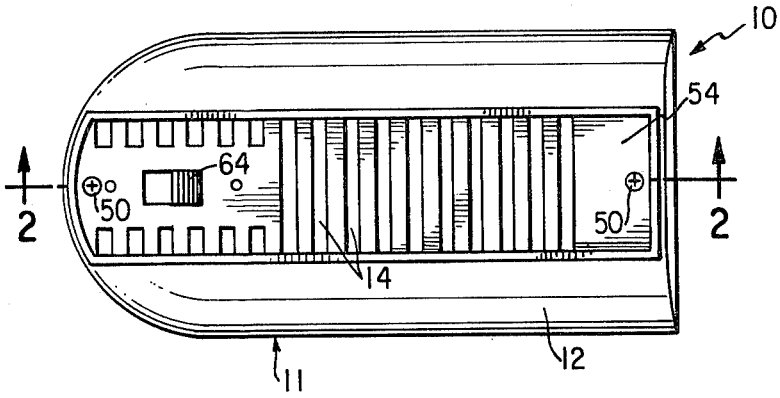
FIG. 1
FIG. 2
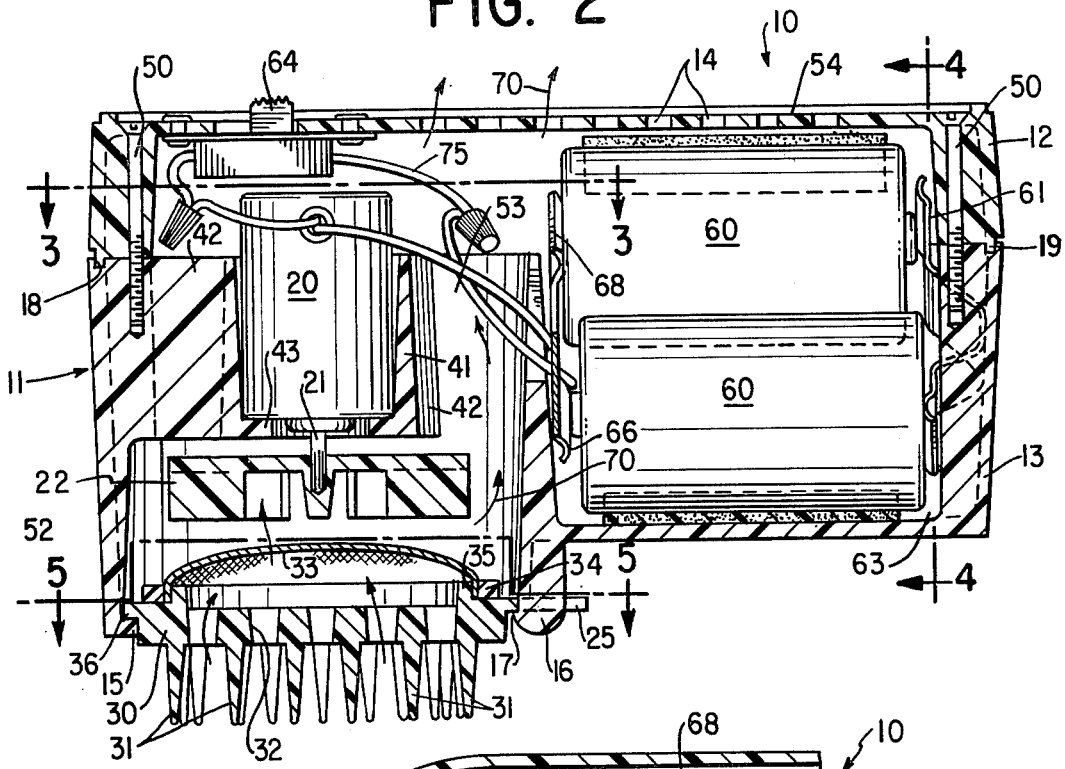
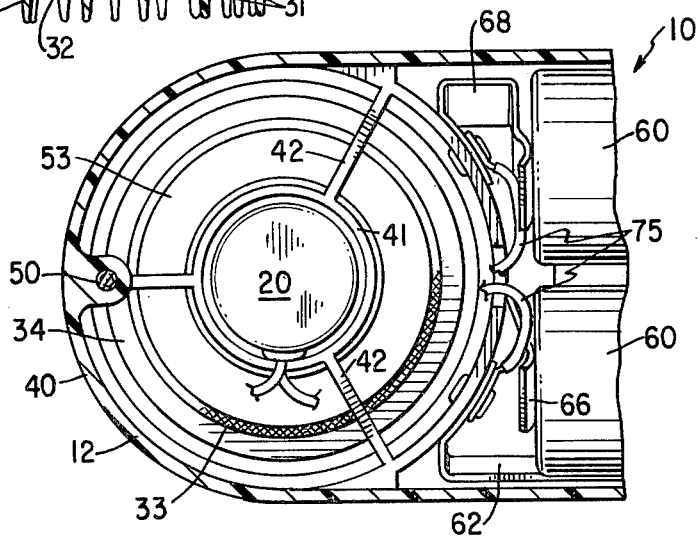
FIG. 3

VACUUM DEVICE FOR HAIR

BRIEF SUMMARY OF THE INVENTION

The present invention relates to a device for vacuuming particles from an individual's scalp and in particular, to a device which comprises suction means disposed within a housing through which a passage is provided. The suction means creates a fluid flow through the housing passage capable of transporting particulate matter. An implement member having at least one aperture communicating with the housing passage is detachably mounted to the housing and a filter, disposed transverse the housing passage, collects particulate matter which is transported in the fluid flow.

By way of illustration, the present invention may advantageously be used to clean particulate matter from the scalp and hair of an individual. The type and size of the particulate matter may vary greatly. For example, the particulate matter may include, without limitation, dust, metal filings, sand, dandruff, etc. The portable nature of the device advantageously allows for use of the device in situations where electrical outlets are not readily accessible.

BRIEF DESCRIPTION OF THE DRAWINGS

For a further understanding of the present invention, reference may be had to the accompanying drawings in which:

FIG. 1 is a plan view of an apparatus according to the present invention.

FIG. 2 is a sectional view taken along the line 2—2 of FIG. 1.

FIG. 3 is a partial sectional view taken along the line 3—3 of FIG. 2.

DETAILED DESCRIPTION OF A PREFERRED EMBODIMENT

Figure 4:
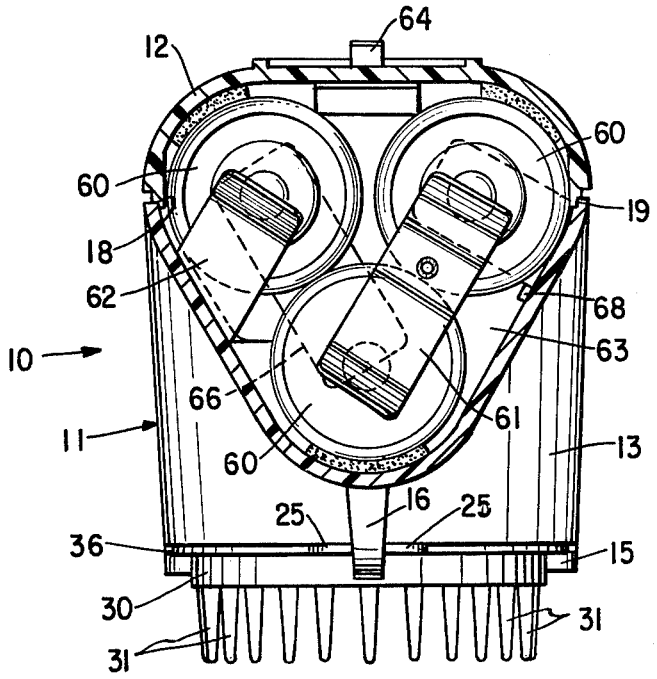
FIG. 4 is a sectional view taken along the line 4—4 of FIG. 2.

Referring now to the drawings and in particular to FIG. 2, there is shown a cross-sectional view of the scalp cleaner which is generally designated by the reference character 10. Housing 11 in the present embodiment is shown as having a two part construction with upper body 12 attached to lower body 13. The two part construction of the housing 11 allows for ready access to the interior of device 11. It should be understood, however, that various alternative constructions of housing 11 are contemplated as within the scope of the present invention. For example, housing 11 may comprise a unitary construction with a detachable plate providing access to power supply 60.

Attachment of the upper body 12 to the lower body 13 may be accomplished in a variety of ways. In the present embodiment, the upper body is provided with a peripheral ridge 19 which engages a matching peripheral groove 18 on the lower body 13. This arrangement provides a simple method of aligning the upper and lower bodies 12, 13. The upper body 12 is detachably affixed to the lower body 13 by means of removable fasteners of any conventional type. In the present embodiment, the fasteners are depicted as screws 50.

A motor 20, compatible with the power supply and capable of creating a fluid flow sufficient to transport particulate matter, is seated in a motor mount 41 attached to the lower body 13 of housing 11. Motor mount 41 is supported to an outer portion 40 of the housing 11 by fins 42 which extend radially outward from the motor mount to the outer portion 40 of housing 11. Between the outer surface of motor mount 41 and the inner surface of the outer cylindrical portion 40 of the housing 11 there is defined an annular space 53 which is punctuated by fins 42. Annular space 53 advantageously allows for flow of fluid, illustratively atmospheric air, from cavity 52 in the lower portion of housing 11, through annular space 53 and out vents 14 arranged on grating 54 at the upper portion of housing 11.

Motor mount 41 is depicted in FIG. 2 as a substantially cylindrical and hollow member. The inner diameter of the cylindrical motor mount 41 is slightly smaller than the diameter of motor 20 so that the interior sidewalls of motor mount 41 will bear against motor 20, thereby tending to retain motor 20 in place. Because of the snug fit, it may be difficult to insert motor 20 into motor mount 41 having vertical interior sidewalls. Accordingly, the inner sidewalls of mount 41 may be sloped so that the diameter of the hollow interior of the motor mount increases as one moves vertically upward along the longitudinal axis of the motor mount. Thus, the motor 20 may easily be inserted into the wide upper portion of the motor mount 41. When fully seated within motor mount 41, the narrower lower portion of motor mount 41 will bear against the lower portion of motor 20 so as to retain motor 20 in place. An inwardly protruding annular flange 43 at the lower end of motor mount 41 abuts against the lower portion of motor 20 and further retains motor 20 within motor mount 41.

Drive shaft 21 of motor 20 extends through the aperture of the annular flange 43 into cavity 52. A fan 22 attached to drive shaft 21 is rotatable within cavity 52. A plurality of conventional blades are arranged on fan 22 so that upon rotation of the fan the ambient fluid, illustratively atmospheric air, will flow in the direction of arrows 70 thereby creating a suction at the lower portion of the device which is capable of transporting particulate matter in the fluid flow.

An implement member 30, having at least one aperture 32 therethrough, is detachably affixed to housing 11. As shown in the present embodiment, implement member 30 is a generally disc-like member having a plurality of apertures 32 therethrough. When affixed to housing 11, apertures 32 are in communication with cavity 52. Thus, a continuous passage between aperture 32, cavity 52, annular space 53, and vents 14 is defined.

Implement member 30 may be provided with a plurality of substantially parallel teeth 31 which are capable of dislodging particulate matter from a workpiece. For example, when the device of the present invention is used as a scalp cleaner, the teeth 31 will penetrate the individual's hair and contact the scalp so as to dislodge particulate from the scalp. The suction created adjacent to the implement member will transport the dislodged particulate through the aperture(s) 32 for collection on filter 33.

The teeth 31 may also be provided with the capability of vibrating so as to more efficaciously dislodge particulate matter from the workpiece. Vibration of the teeth 31 may be accomplished in a variety of ways. For example, a second vibratory motor may be provided to vibrate implement member 30 and teeth 31. Alternatively, a vibration-creating linkage adapted to motor 20 may vibrate teeth 31 and implement member 30.

Although the implement member of the present embodiment is shown as having a plurality of substantially parallel teeth 31, it should be understood that the present invention contemplates implement members 30 having any of a variety of alternative implements suited to a particular application provided thereon. Each implement member 30 is detachably affixed to housing 11 so as to achieve the desired interchangeability of alternative implement members 30.

Figure 5:
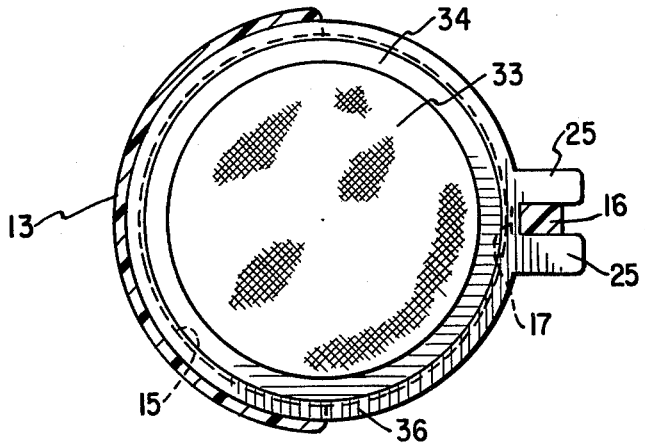
FIG. 5 is a sectional view taken along line 5—5 of FIG. 2.

In the present embodiment, the detachable mounting of implement member 30 to housing 11 is achieved as follows. An annular flange 36 extends radially outward along the circumferential periphery of implement member 30. Annular flange 36 is dimensioned to mate with a corresponding flange 15 provided at a lower portion of housing 11. As seen in FIG. 5, housing flange 15 encompasses one half or less of the circumferential periphery of implement member 30. A projection 16 having a protruding barb 17 is provided on housing 11 such that the barb faces toward the housing flange 15. Implement member 30 is attached to housing 11 by positioning implement member 30 at an incline so that the portion of flange 36 corresponding to flange 15 can be slid into engagement with the housing flange 15. Since flange 15 encompasses one half or less of the circumferential perimeter of implement member 30, flange 15 does not interfere with the lower half of the inclined implement member. Implement member 30 is detachably affixed to the housing 11 by urging the portion of implement member 30 positioned below projection 16 upward so that barb 17 engages a corresponding portion of flange 36. Either or both of implement member 30 and projection 16 are of a suitably resilient material such that, during attachment of implement member 30 to projection 16, flange 36 is capable of passing beyond the protruding barb 17. Tabs 25 provided at the circumferential periphery of implement member 30 may be grasped to assist in urging the implement member 30 into and out of engagement with barb 17 on projection 16.

A filter 33 is mounted transverse to cavity 52 so as to entrap particulate matter which would otherwise be transported through the passage in housing 11 by the suction created by rotating fan 22. It should be understood that the filter will have a plurality of pores of size small enough to entrap the particulate matter while at the same time allowing passage of the fluid, illustratively atmospheric air. Thus, depending on the particulate to be entrapped, filters of varying pore size may be used.

In the present embodiment, filter 33 is mounted to implement member 30 by placing filter 33 across an annular rim 35 of implement member 30. Annular rim 35 protrudes from and is perpendicular to the horizontal plane of implement member 30. In addition, annular rim 35 encompasses apertures 32 so that particulate entering any of the apertures 32 will be entrapped on filter 33. A locking ring 34 is pressed into engagement with annular rim 35 so that the circumferential periphery of filter 33 is held interjacent the annular rim 35 and the locking ring 34. The dimensions of locking ring 34 are such that the ring 34 provides sufficient pressure against the circumferential periphery of filter 33 to hold filter 33 onto annular rim 35 of implement holder 30.

In the present embodiment, the power supply for motor 20 is encompassed within a compartment 63 of housing 11 so that the entire apparatus 10 constitutes a portable unit. A power supply 60 of any conventional type may be utilized. By way of illustration, the power supply may comprise alternating or direct current power supplies. A battery source or an external electrical source, illustratively an electrical outlet, may be utilized. In FIG. 2, the power supply 60 is illustratively shown as three size "D" batteries which are connected in series by means of conventional metallic electrical contacts 61, 62, 66, 68 and wiring 75. It will be apparent that, depending on the nature of the motor 20 utilized and the desired size of the overall apparatus, the number, size, and wiring (e.g., parallel v. series) of the batteries may vary. By way of illustration, the power supply may alternatively comprise a single 9-volt battery or several "D" or other sized batteries wired in parallel. It should be understood that the particular motor chosen for the apparatus will be compatible with the particular power supply provided. For example, in the present embodiment, an approximately 10,000 RPM 4.5 volt motor is utilized.

A conventional switch 64 may be provided to allow turning on and off of the device. In the present embodiment, the switch is shown as a slide switch of a conventional type.

It will be apparent to those having ordinary skill in the art that the present invention may take a variety of forms and that the foregoing description is merely illustrative. Accordingly, the scope of protection afforded this invention is not to be limited except as defined by the appended claims.

What is claimed is:

1. A scalp cleaner for vacuuming particulate matter from an individual's scalp comprising:

a housing having a passage therethrough and a power supply compartment, a motor, a rotatable fan driven by said motor capable of creating a fluid flow through said passage to transport said particulate matter, a hollow motor mount disposed within said housing passage having a plurality of radially extending fans supporting said motor mount to said housing, said motor seated within said motor mount so that the sidewalls of said motor mount bear against said motor, a filter mounted transverse said passage for entrapping said transported particulate matter, an implement member having a plurality of substantially parallel teeth extending therefrom detachably mounted to said housing, said implement member having at least one aperture communicating with said passage therethrough, an annular flange extending radially outward from said implement member, a portion of said annular flange detachably mating with a corresponding flange on said housing, said housing flange defining a semi-circle or a portion thereof, an annular rim protruding from and perpendicular to the horizontal plane of said implement member, said annular rim encompassing said at least one aperture, a ring detachably affixed to said annular rim so as to impinge the circumferential periphery of said filter interjacent said ring and said annular flange, a barbed projection extending from said housing, the barb of said projection detachably engaging a portion of said annular flange when said annular flange is urged upward against said barb, electrical contacts arranged in said power supply compartment for transmitting electrical power to said motor; and switch means for selectively transmitting power to said motor.

2. The scalp cleaner of claim 1 wherein the interior sidewalls of said motor mount are sloped so that the lower portion of said motor mount bears against said motor.

* * * * *